US008534726B2

(12) United States Patent
Bulatao

(10) Patent No.: US 8,534,726 B2
(45) Date of Patent: Sep. 17, 2013

(54) TABLE TENNIS BALL COLLECTOR AND DISPENSER

(76) Inventor: Jose Bulatao, Las Vegas, NV (US)

( * ) Notice: Subject to any disclaimer, the term of this patent is extended or adjusted under 35 U.S.C. 154(b) by 0 days.

(21) Appl. No.: 13/239,116

(22) Filed: Sep. 21, 2011

(65) Prior Publication Data

US 2012/0099959 A1 Apr. 26, 2012

Related U.S. Application Data

(60) Provisional application No. 61/455,412, filed on Oct. 21, 2010.

(51) Int. Cl.
*A63B 47/02* (2006.01)

(52) U.S. Cl.
USPC ..... 294/19.2

(58) Field of Classification Search
USPC ..... 294/19.2, 23, 209, 179, 1.4; 56/332, 56/327.1, 328.1; 248/99, 100, 101; 15/257.3; 473/286; 43/11, 19
See application file for complete search history.

(56) References Cited

U.S. PATENT DOCUMENTS

| | | | | | |
|---|---|---|---|---|---|
| 1,723,709 | A | * | 8/1929 | Reiser | 294/19.2 |
| 2,205,706 | A | * | 6/1940 | Wolff | 210/495 |
| 3,220,307 | A | * | 11/1965 | Thurow | 359/677 |
| 3,982,781 | A | * | 9/1976 | Tucker et al. | 294/19.2 |
| 4,003,100 | A | * | 1/1977 | Whitaker | 15/1.7 |
| D267,593 | S | * | 1/1983 | Crawford et al. | D34/1 |
| 4,509,751 | A | * | 4/1985 | Tabet | 473/407 |
| 4,596,413 | A | * | 6/1986 | La Porte | 294/99.1 |
| 4,799,725 | A | * | 1/1989 | Anderson | 294/19.2 |
| 4,828,690 | A | * | 5/1989 | Montez | 209/418 |
| 4,964,665 | A | * | 10/1990 | Crow | 294/19.2 |
| 5,513,884 | A | * | 5/1996 | Bucher | 294/19.2 |
| D393,300 | S | * | 4/1998 | Andrews et al. | D21/721 |
| D457,932 | S | * | 5/2002 | Bellville | D21/789 |
| 7,377,565 | B1 | * | 5/2008 | Beavin | 294/19.2 |

FOREIGN PATENT DOCUMENTS

| | | | |
|---|---|---|---|
| JP | 2008253405 | * | 10/2008 |
| JP | 2009-189768 | | 8/2009 |

* cited by examiner

*Primary Examiner* — Paul T Chin
(74) *Attorney, Agent, or Firm* — Weide & Miller, Ltd.

(57) ABSTRACT

A table tennis ball collector and dispenser collects and secures table tennis balls with minimal effort. The collector may comprise a frame supporting one or more cross members arranged to allow one or more table tennis balls to enter therebetween. A tubular elastic sleeve having open receiving and dispensing ends may be attached to the frame to capture table tennis balls that advance beyond the cross members. The sleeve may taper towards its dispensing end to secure the table tennis balls within. Individual or multiple collected table tennis balls may be dispensed by applying force to push the table tennis balls out of the dispensing end of the sleeve. A handle extending from the frame allows the user to position the frame 120 for collection and dispensing of table tennis balls.

19 Claims, 3 Drawing Sheets

TABLE TENNIS BALL COLLECTOR AND DISPENSER

CROSS-REFERENCE TO RELATED APPLICATION

This application claims priority to U.S. Provisional Application No. 61/455,412, filed Oct. 21, 2010.

BACKGROUND OF THE INVENTION

1. Field of the Invention

The invention relates to table tennis accessories and in particular to a table tennis ball collector and dispenser.

2. Related Art

Table tennis is a fun and entertaining sport for novices and professionals alike. One drawback to the sport is that table tennis balls are, by the nature of the game, small. This allows table tennis balls to position themselves in hard to reach places during play. Though players may have a large number of table tennis balls, at some point, play typically must be stopped to retrieve the table tennis balls. Since, as stated above, the table tennis balls may be difficult to reach, this delays play time and detracts from the enjoyment of table tennis as a whole.

Players can pick up table tennis balls by hand. However, this requires repeated bending, stooping, and even crawling to reach the table tennis balls. Depending on the skill level of the players, picking up table tennis balls may occupy a significant amount of play time, requires a great deal of effort, and could lead to back or other injury.

From the discussion that follows, it will become apparent that the present invention addresses the deficiencies associated with the prior art while providing numerous additional advantages and benefits not contemplated or possible with prior art constructions.

SUMMARY OF THE INVENTION

A table tennis ball collector is disclosed herein. The table tennis ball collector may be used to both collect and dispense table tennis balls. As will be described herein, the table tennis ball collector allows one or multiple table tennis balls to be collected with minimal effort and provides storage for the collected table tennis balls. In addition, the table tennis ball collector has added versatility in that a user can dispense as many table tennis balls from the collector as desired.

Various embodiments of the table tennis ball collector are disclosed herein. For example, in one embodiment a table tennis ball collector may comprise a frame having an opening configured to accept a plurality of table tennis balls therein, a plurality of substantially parallel cross members extending across the opening of the frame, and a tubular sleeve having a first open end and a second open end. The first end of the sleeve may be attached to a periphery of the frame. In such manner, the first end of the sleeve may have a larger diameter than the second end to attach to the periphery of the frame. The sleeve may be formed from an elastic material selected from the group consisting of mesh and fabric.

A distance between at least two of the plurality of substantially parallel cross members is set according to a diameter of a table tennis ball. For example, the substantially parallel cross members may be spaced apart a distance the same or similar to or less than the diameter of a table tennis ball.

A handle may extend outward from the frame. It is contemplated that the handle comprises at least one bend such as to allow the frame to be more easily positioned for collecting table tennis balls. An extension may be attached at the distal end of the handle to extend the length of the handle.

The frame may have a plurality of holes at its periphery to accept and secure the plurality of cross members. For example, the frame comprises a plurality of pairs of holes at its periphery to secure both ends of each of the plurality of substantially parallel cross members. It is noted that the frame may also include at least one additional pair of holes to allow at least one of the plurality of substantially parallel cross members to be repositioned. For example, a cross member may be moved from to one of the additional pairs of holes to reposition it. This is advantageous in that it alters the spacing of the cross members such as to accommodate table tennis or other balls of various sizes.

In another exemplary embodiment, a table tennis ball collector may comprise a frame having an opening to accept one or more tennis balls therein, one or more cross members attached to the frame and spanning across the opening, and a tubular elastic sleeve having a first open end and a second open end. The first end may be attached to a periphery of the frame. In this manner the tubular elastic sleeve tapers from an enlarged size at the first open end to a smaller size at the second open end. The second open end may have a diameter less than a diameter of the table tennis balls to secure the table tennis balls therein. A handle may extend from the frame for the user to grasp while operating the collector. Similar to above, the elongated members may be spaced apart a distance less than a diameter of the table tennis balls.

The frame may comprise a plurality of mounts to which the cross members are mounted or attached to the frame. For example, the frame may have a plurality of holes so that the cross members may be strung through the plurality of holes to attach the cross members to the frame. It is noted that the cross members may be strung through some but not all of the plurality of holes to attach the cross members to the frame. This allows the cross members to be moved to other positions if desired, such as to accommodate tennis or other balls of various sizes.

Various methods of forming a table tennis collector and collecting table tennis balls are disclosed herein as well. For example, in one embodiment a method of collecting table tennis balls with a table tennis ball collector may comprise attaching one or more cross members to a frame such that the cross members span across an opening of the frame, stretching a first open end of an elastic tubular sleeve, and attaching the first open end of an elastic tubular sleeve to the periphery of the frame such that once attached the first open end is stretched relative to a second open end of the elastic tubular sleeve. The cross members may be attached to the frame by stringing the cross members through one or more holes in the periphery of the frame.

In operation, the opening of the frame may be positioned adjacent one or more table tennis balls, and pressure may be applied to the frame to push the table tennis balls through the cross members and into the first open end of the elastic tubular sleeve.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

Figure 1:
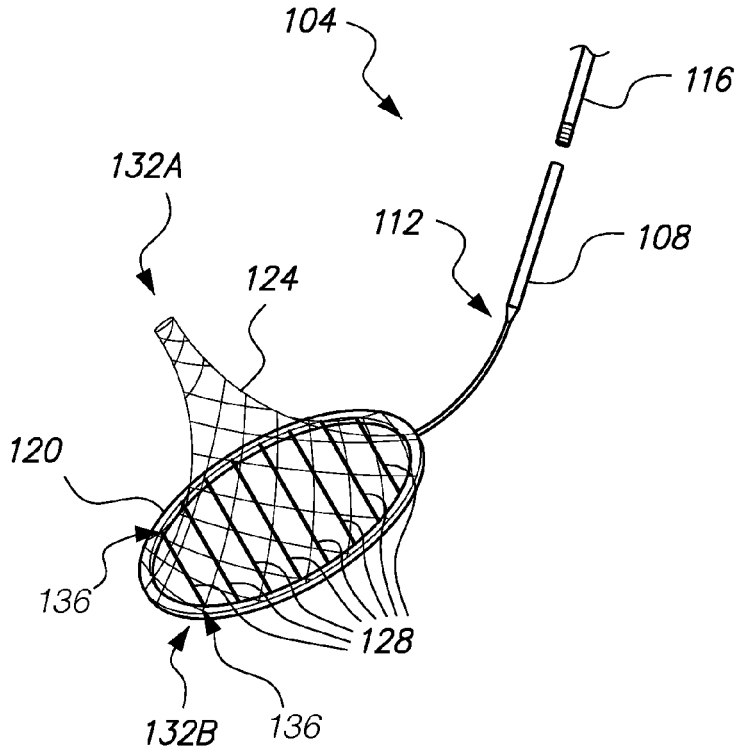
FIG. 1 is a perspective view of an exemplary embodiment of the table tennis ball collector and dispenser.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the table tennis ball collector and dispenser (hereinafter the "collector") disclosed herein allows user to quickly an easily gather or collect even a large number of table tennis balls. Using the collector, table tennis balls can be collected from hard to reach places with a simple safe motion. In other words, users need not concentrate of properly positioning the collector relative to one or more table tennis balls in order for the collector to work. In addition, the collector includes a dispenser feature which allows the collected table tennis balls to be easily dispensed such as for further play. Also, the collector may serve as a storage device for table tennis balls that have been collected therein.

Practice against a mechanical or robotic ball throwing machine called a ping pong robot typically results in dozens of balls become scattered across the playing area that then need to be picked up and reloaded back into the machine. Traditionally this has occurred by hand, which is quite time consuming and which takes away from practice time.

In addition, during multiball practice, where a coach having a bucketful (or other large number) of balls, continuously hits individual balls towards the student until the bucket is empty also results in many table tennis balls being strewn all over the practice area. In this case as well, the table tennis balls would need to be picked up and reloaded back to the bucket before practice may continue. In addition, removing the table tennis balls from the play area increases safety (by removing a tripping hazard) and prevents the tennis balls from being stepped on or otherwise damaged. The collector herein greatly speed the process and increases efficiency of collecting table tennis balls while being easy to use.

The collector will now be described with reference to FIGS. 1-2. In one or more embodiments, the collector 104 may comprise a handle 108 and frame 120. As can be seen, the frame 120 may be connected to the handle 108 so that the frame 120 may be manipulated via the handle. In general, the handle 108 will be configured to allow a user to grasp and/or hold the frame 120. A user may then operate or use the collector 104 using the handle 108.

In one or more embodiments, the handle 108 may be elongated so as to hold the frame 120 some distance from the user. This extends the user's reach so that the user need not stretch, bend, or otherwise contort his or her body to reach one or more table tennis balls.

As can be seen, the handle 108 may also include one or more bends 112 or angles so as to allow the user to reach even difficult to reach areas with the frame 120. As shown in FIGS. 1-2, a bend 112 may be configured to position the frame 120 substantially parallel to the ground or other surface when the collector 104 is in use. This allows a user to grasp the handle 108 naturally when using the collector 104. It is contemplated that the bend 112 may be various angles to provide ergonomic use for various users. For example, in one embodiment, there may be a 45 degree bend 112 in the handle.

It is contemplated that the handle 108 may have one or more extensions 116 configured to extend the length of the handle 108 so that a user can reach further with the collector 104 and dispense table tennis balls at an increased distance. To illustrate, attaching an extension 116 may lengthen the handle by 3 ft in some embodiments. The length of the handle 108 with or without an extension 116 also allows users to pick up table tennis balls while others are in motion and swinging (i.e., in play), and to do so from a safe distance. A distal end of the handle 108 (the end opposite the frame 120) may have a connector, coupling, or the like to allow an extension 116 to be secured thereto. For example, a threaded connection may be made between the handle 108 and an extension 116 at the distal end of the handle by twisting or rotating the extension 116 relative to the handle.

Alternatively, a friction fit coupling may connect an extension 116 to the handle. For example, the distal end of the handle 108 may have a female connector that accepts a male connector of the extension 116, or vice versa. In addition or alternatively, it is contemplated that one or more fasteners, such as pins or screws could be used to secure an extension 116 to the handle 108. It is contemplated that extensions 116 may be secured in various other ways. In addition, in some embodiments, one or more extensions 116 may be built into a handle 108. For example, the handle 108 may comprise one or more extensions 116 that telescope from a distal end of the handle.

Figure 2:
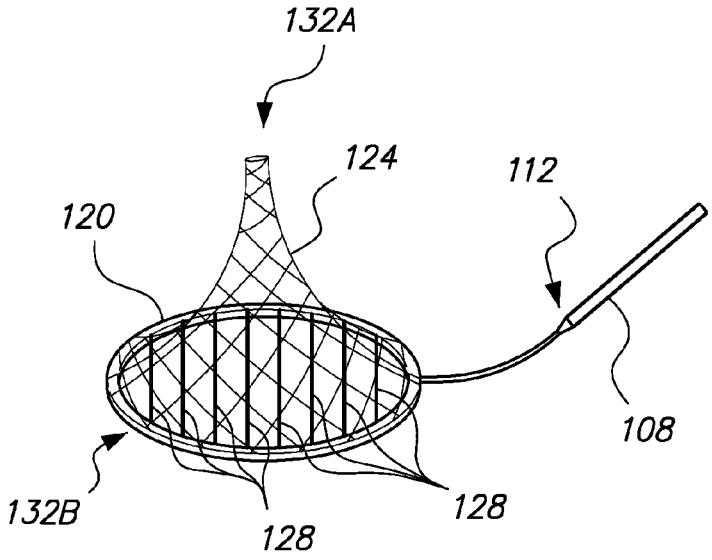
FIG. 2 is a side view of an exemplary embodiment of the table tennis ball collector and dispenser.

In one or more embodiments, the frame 120 may provide a structure for supporting one or more cross members 128, such as the rounded open structure shown in FIGS. 1-2. The frame 120 may have various shapes and sizes. For example an increased size may allow an increased number of table tennis balls to be collected simultaneously. A reduced size or tapered or similar shape may be used to collect table tennis balls in locations having various "nooks and crannies" or other hard to reach areas.

As can be seen, the cross members 128 may be elongated members attached to the frame 120. The cross members 128 may be cables, cords, or other elongated structures. The cross members 128 will typically be resilient so as to be bendable when the collector 104 is in use. As will be described further below, the cross members 128 may be used to collect and retain one or more table tennis balls.

In some embodiments, the frame 120 may comprise one or more mounts 136 to allow the cross members 128 to attach thereto. For example, the frame 120 may have one or more mounts 136 in the form of holes to allow cross members 128 to be inserted therein and attach to the frame. It is contemplated that cross members 128 may be "strung" onto the frame such as by weaving a cord or cable through the openings/mounts of the frame 120. There may be a series of mounts on the frame 120 to allow cross members 128 to be attached at various locations. This allows the cross members 128 to be spaced apart at various distances, such as to pick up particular table tennis or other balls.

The cross members 128 may be attached at various spacings or intervals on the frame 120. For example, in FIGS. 1-2 the cross members 128 have been installed such that they are spaced apart at the same or substantially the same distance. In one or more embodiments, this distance may be set according to the size of a table tennis ball. Typically, the distance will be slightly smaller than the diameter of a table tennis ball. In this manner, the cross members 128 will have to bend to accept a table tennis ball during the collection procedure, as will be detailed further below. This allows the cross members 128 to pick up table tennis balls.

It is contemplated that the cross members 128 may be spaced apart according to balls of various sizes. For example, the cross members 128 may be spaced apart based on the diameter of a golf ball, tennis ball, squash ball, or other ball. Typically, the spacing will be smaller than the diameter of the ball to be collected. It is noted that in some embodiments, the spacing of the cross members 128 may be non-uniform so as to allow the collector 104 to pick up balls of various sizes.

In one or more embodiments, the cross members 128 may be parallel or substantially parallel to one another. This forms elongated openings between the cross members 128 where a table tennis ball may enter as it is being collected. Since the cross members 128 may be formed from a resilient material, they may bend to accept a table tennis ball and then straighten to prevent the table tennis ball from dropping, as will be described further below.

As can also be seen, the collector 104 may include a sleeve 124 configured to contain or hold table tennis balls that are collected. For example, the sleeve 124 may be a net or mesh material that forms an open-ended compartment to store a dispense table tennis balls. Other flexible materials (synthetic, natural, or both) such as fabric could be used as well. Typically, the sleeve 124 is formed from an elastic or resilient material having two open ends 132A, 132B. For example, the sleeve 124 may be a elastic or resilient material formed as a tube having openings at both its ends 132A, 132B. A receiving end 132B may be secured to the frame 120, while a dispensing end 132A may be left unsecured. This stretches the receiving end 132B. As can be seen from FIGS. 1-2 the elasticity of the sleeve 124 is attached at a peripheral edge of the frame, thus forming a conical shape that is wider at its receiving end 132B as compared to its dispensing end 132A.

As its name implies, the receiving end 132B may accept the one or more table tennis balls collected by the collector 104. As will be described further below, table tennis balls entering between a pair of cross members 128 (or a cross member and the frame 120) may then enter at the receiving end 132B of the sleeve 124. Since the sleeve 124 tapers as it reaches its dispensing end 132A, any collected table tennis balls are secured within the sleeve 124. This is advantageous in that the collector 104 also provides storage for table tennis balls.

When desired for use or other purposes, one or more of the table tennis balls may be dispensed, such as via the dispensing end 132A of the sleeve 124. This is possible because the sleeve 124 has two open ends 132A,132B, with the dispensing end 132A being usable to remove or dispense collected table tennis balls from the collector 104.

The opening at the dispensing end 132A is highly advantageous as a way of providing access to collected table tennis balls. For one, when table tennis ball collection is complete, the collector 104 may be supported on a surface with its frame 120 contacting the surface. This keeps the dispensing end 132A oriented upward thus allowing a user to easily remove individual or a plurality of table tennis balls from the top of the collector 104. During play for example individual table tennis balls could be removed from the collector quickly and conveniently.

The opening at the dispensing end 132A also allows dispensing of collected table tennis balls in other ways. For example, a user could quickly dispense multiple or all of the collected table tennis balls by squeezing the table tennis balls out of the dispensing end 132A. The user may in this manner dispense a plurality of table tennis balls, such as into a container or machine.

The elasticity of the sleeve 124 allows a large number of table tennis balls to be collected. In fact the sleeve 124 is capable of stretching outward to accept additional table tennis balls. The elasticity of the sleeve 124 ensures that the dispensing end 132A remains narrow, thus securing any table tennis balls during collection, while also permitting the table tennis balls to be quickly and easily dispensed individually or in numbers.

The table tennis balls are thus removably secured by the sleeve without latches, doors, flaps, or the like. In traditional containers, without closing a door, flap, or the like, contents within such containers may fall out. Thus, with the collector 104 a user may simply use the collector without first closing a door, flap, or the like or even checking if such door, flap, or the like is closed. This increases the speed and convenience at which table tennis balls may be collected.

Figure 3:
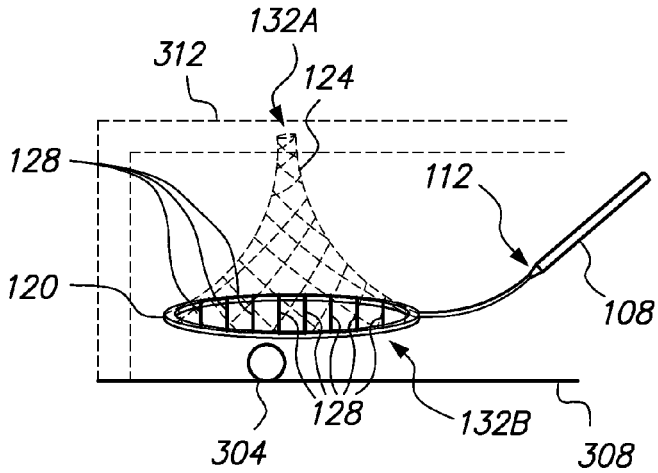
FIG. 3 is a side perspective view of an exemplary embodiment of the table tennis ball collector and dispenser positioned over a table tennis ball.

Operation of the collector 104 will now be described with regard to FIGS. 3-8. In general, FIGS. 3-8 illustrate how the collector 104 may be used to collect and dispense one or more table tennis balls 304. The table tennis balls 304 are shown on an exemplary surface 308 from which they are collected. This surface may be the ground or floor, table top, or virtually any other surface where a table tennis ball may land, such as on furniture, etc . . . FIG. 3 also illustrates an exemplary obstruction 312 which would ordinarily hinder collection of a table tennis ball 304. As can be seen, the collector 104 is not hindered by such obstruction 312. For example, the obstruction 312 may be a building structure, furnishing, the table tennis table, or other structures. The bend 112 of the handle 108 allows the frame 120 and sleeve 124 to be easily positioned to collect a table tennis ball 304. It can thus be seen that the user may pick up a table tennis ball 304 with the collector 104 without having to stoop, reach, or otherwise contort his or her body.

Figure 4:
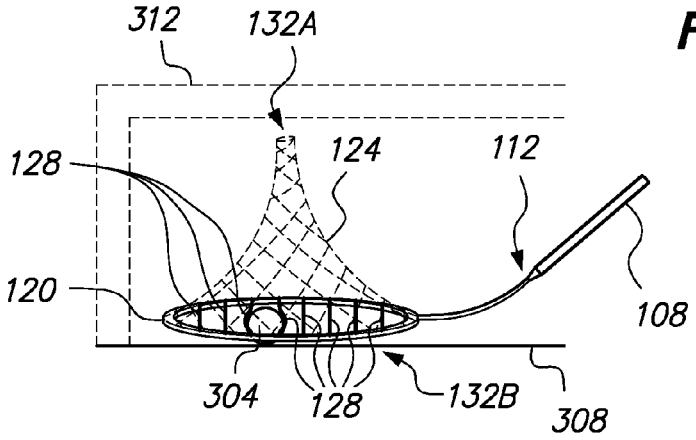
FIG. 4 is a side perspective view of an exemplary embodiment of the table tennis ball collector and dispenser collecting a table tennis ball.
Figure 5:
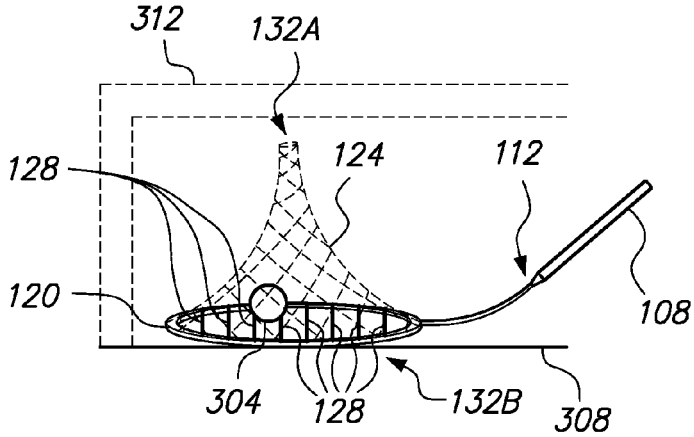
FIG. 5 is a side perspective view of an exemplary embodiment of the table tennis ball collector and dispenser storing a table tennis ball.
Figure 6:
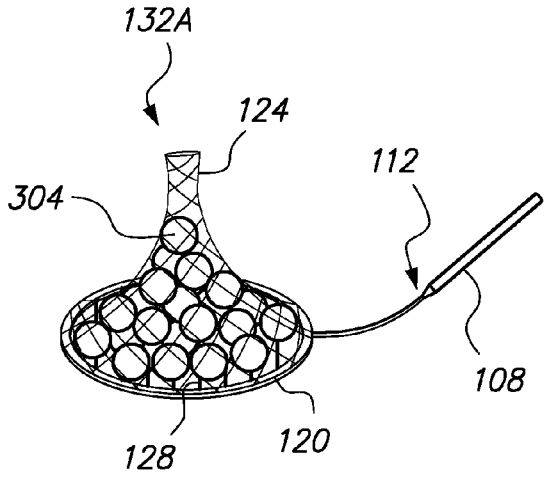
FIG. 6 is a side perspective view of an exemplary embodiment of the table tennis ball collector and dispenser after collecting a plurality of table tennis balls.

Referring to FIG. 3, the collector's frame 120 may be positioned upright above a table tennis ball 304 to be collected. An upright orientation may be one where the frame 120 is positioned downward with the sleeve 124 located above, such as shown in FIG. 3. As shown in FIGS. 4-5, the frame 120 may then be moved downward to collect the table tennis ball 304. As shown in FIG. 4, the table tennis ball 304 stretches or bends the cross members 128 as it enters therebetween. As shown in FIG. 5, once the table tennis ball 304 advances beyond the cross members 128 (and into the receiving end 132B of the sleeve 124), the cross members return to their undistorted shape (i.e., straighten) thus securing the table tennis ball 304 within the collector 124.

It can thus be seen that the collector 104 makes it easy to pick up and collect table tennis balls. The user need not carefully aim or target a table tennis ball 304. This is because, the table tennis ball 304 will be forced between the cross members 128 or a cross member and the frame 120 as the frame is moved downward over the table tennis ball 304. In addition, multiple table tennis balls may be picked up and collected in this manner, increasing the speed and convenience of collection. As disclosed above, the sleeve's taper will secure any collected table tennis balls 304 until they are dispensed.

Figure 7:
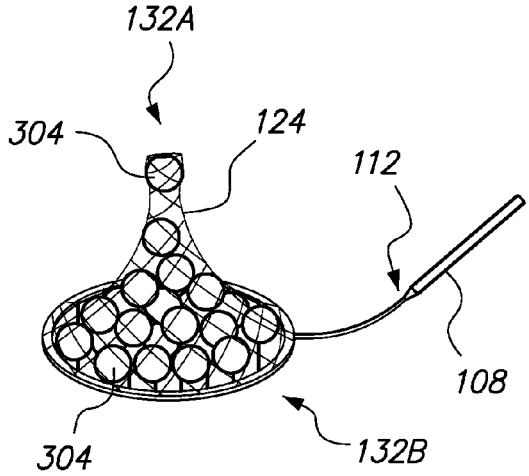
FIG. 7 is a side perspective view of an exemplary embodiment of the table tennis ball collector and dispenser dispensing a table tennis ball.
Figure 8:
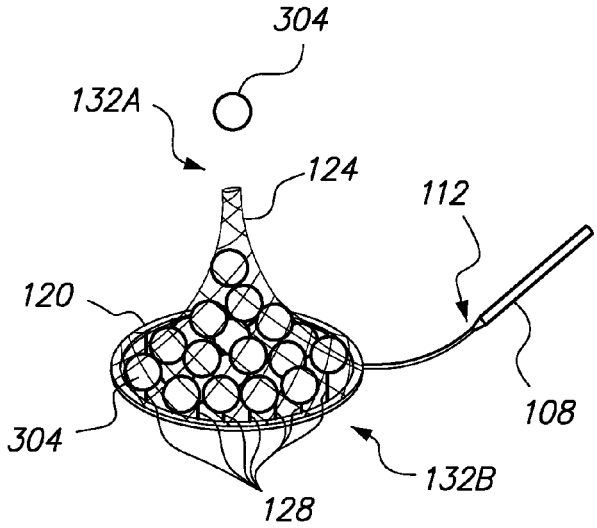
FIG. 8 is a side perspective view of an exemplary embodiment of the table tennis ball collector and dispenser after dispensing a table tennis ball.

FIGS. 7-8 illustrate the dispensing of a table tennis ball 304. As can be seen, the opening at the dispensing end 132A may be narrower than the diameter of a table tennis ball 304. This secures the table tennis balls 304 in the collector 104 even if the collector 104 were to be turned upside down (with the dispensing end 132A pointed downward). This is despite the fact that the sleeve 124 has an opening at its dispensing end 132A.

As shown in FIG. 7, a table tennis ball 304 is being forced out of the sleeve 124. As can be seen, as the table tennis ball 304 exits the sleeve it stretches the sleeve 124 at the dispensing end 132A so that it can pass through the opening at the dispensing end. As can also be seen, individual table tennis balls 304 can be dispensed from the collector 104 in this manner. This is highly advantageous during practice or play since users will typically only need on table tennis ball 304 at a time. In addition, users can take individual table tennis balls 304 directly from the collector 104 thus eliminating a step of dispensing the collected table tennis balls 304 into an intermediary container or storage unit.

Once a table tennis ball 304 is dispensed, any other table tennis balls 304 still in the collector 104 remain secured, such as shown in FIG. 8. This is because the elasticity of the sleeve 104 collapses the sleeve, such as at dispensing end 132A, around the remaining table tennis balls 304.

It is noted that a clip. String, rubber band or other fastener can be used to temporarily close the dispensing end 132A and when the device 104 is positioned vertically or horizontally with the closed dispensing end 132A at the bottom, individual balls can be pulled out using fingers between two cross members 128 to start each new rally. In other words, table tennis balls may be dispensed through the cross members 128 in some situations. Multiple table tennis balls can also be dispensed out in the same manner. If all balls needed to be emptied it could be done by using the open palm to push the dispensing end 132A towards the other end 132B forcing all the balls inside the sleeve 120 to exit between the flexible cross members 128 or simply by removing any fastener used to temporarily close the dispensing end 132A and letting the balls exit through the dispensing end 132A.

The collector 104 is highly versatile, and can dispense individual or multiple table tennis balls 304 in rapid fashion as disclosed above. For example, a user may apply pressure, such as by squeezing, onto the sleeve 124, thus forcing multiple table tennis balls 304 out of the collector 104. By applying less force, a user may dispense individual table tennis balls 304 or fewer table tennis balls. It is contemplated that in an upright orientation, such as shown in FIGS. 7-8, a user may reach into the opening at the dispensing end 132A to retrieve individual table tennis balls, such as for play.

As can be seen, the collector 104 collects table tennis balls quickly and easily in a variety of situations, including when a table tennis match is being played. Any number of table tennis balls may be retrieved with minimal effort. In addition, the collector 104 utilizes a configuration that does not require latches, doors, or the like to secure table tennis balls therein. The sleeve 124 of the collector 104 allows table tennis balls to be collected, secured and dispensed quickly and easily so that users may focus on playing table tennis.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A table tennis ball collector comprising:

a frame having an opening configured to accept a plurality of table tennis balls therein;

a plurality of substantially parallel cross members extending across the opening of the frame, wherein a distance between at least two of the plurality of substantially parallel cross members is set according to a diameter of a table tennis ball;

a handle extending outward from the frame, the handle having a first end connected to the frame and a second end distal from the frame, and the handle between the first end and a middle of the handle being curved; and a tubular elastic sleeve having a first open end stretched around the opening of the frame, and a second open end in its unstretched state sized to contain one or more table tennis balls and in its stretched state sized to allow the one or more table tennis balls to pass therethrough, the second open end configured to contain the one or more table tennis balls until the second open end is stretched to dispense the one or more table tennis balls such that the one or more table tennis balls completely exit the table tennis ball collector.

2. The table tennis ball collector of claim 1, wherein the handle extends upward from the frame at an angle between 35 to 45 degrees and the sleeve extends vertically from the frame.

3. The table tennis ball collector of claim 1 further comprising an extension at the distal end of the handle to extend the length of the handle.

4. The table tennis ball collector of claim 1, wherein the sleeve is formed from an elastic material selected from the group consisting of mesh and fabric.

5. The table tennis ball collector of claim 1, wherein the frame comprises a plurality of holes at its periphery to accept and secure the plurality of cross members.

6. The table tennis ball collector of claim 1, wherein the frame comprises a plurality of pairs of holes at its periphery to secure both ends of each of the plurality of substantially parallel cross members.

7. The table tennis ball collector of claim 6, wherein the frame comprises at least one additional pair of holes to allow at least one of the plurality of substantially parallel cross members to be repositioned.

8. A table tennis ball collector comprising:

a frame having an opening to accept one or more tennis balls therein;

one or more cross members attached to the frame and spanning across the opening;

a tubular elastic sleeve having a first open end and a second open end, the first end attached to a periphery of the frame, wherein the tubular elastic sleeve tapers from an enlarged size at the first open end to a smaller size at the second open end, the second open end being elastically expandable to pass a table tennis ball through the second open end, wherein the tubular elastic sleeve is required to be squeezed in order to dispense the table tennis ball from the table tennis ball collector; and a curved handle extending from the frame the curve being between a first handle end that connect to the frame and a middle of the handle.

9. The table tennis ball collector of claim 8, wherein the one or more cross members are spaced apart less than a diameter of a table tennis ball.

10. The table tennis ball collector of claim 8, wherein the one or more cross members are spaced apart a distance less than a diameter of the one or more table tennis balls.

11. The table tennis ball collector of claim 8, wherein the handle extends upwards at an angle from the frame and the sleeve extends vertically upward from the frame.

12. The table tennis ball collector of claim 8, wherein the second open end has a diameter less than a diameter of the one or more table tennis balls.

13. The table tennis ball collector of claim 8, wherein the frame comprises a plurality of mounts to which the one or more cross members are mounted.

14. The table tennis ball collector of claim 8, wherein the frame comprises a plurality of holes, the one or more cross members strung through the plurality of holes to attach the one or more cross members to the frame.

15. The table tennis ball collector of claim 8, wherein the frame comprises a plurality of holes, the one or more cross members strung through some but not all of the plurality of holes to attach the one or more cross members to the frame.

16. A method for a user to collect a table tennis ball with a table tennis ball collector comprising:

grasping a handle of the collector, the collector having a curved handle, a frame having a frame opening, one or more cross members across the frame opening, and a tubular elastic sleeve having a first opening stretched around a periphery of the frame and a second opening extending upwards from the frame, with an interior space being defined by the sleeve, the cross members and the frame, the second opening configured to contain a table tennis ball until the second opening is stretched to dispense the table tennis ball from the table tennis ball collector, wherein the second opening is capable of containing the table tennis ball without a latch, tie, or locking device;

using the curved handle, guiding the frame under a table, table tennis table, or chair while the user grasps the handle standing adjacent the table, table tennis table, or chair;

positioning the frame opening above the table tennis ball;

applying downward pressure to the frame to move at least one of the one or more cross members thereby forcing the table tennis ball into the interior space; and guiding the frame and the table tennis ball contained in the interior space out from under the table, table tennis table, or chair.

17. The method of claim 16, further comprising removing the table tennis ball from the interior space by performing the following steps:

positioning the frame above a container;

rotating the frame such that the frame is above the sleeve; and moving the frame and sleeve up and down to cause the table tennis ball to exit the second end of the sleeve into the container.

18. The method of claim 16, further comprising removing the table tennis ball from the interior space by squeezing the tubular elastic sleeve.

19. The method of claim 16, further comprising extending the length of the handle to guide the frame further under the table, table tennis table, or chair.

* * * * *